US007520774B2

(12) United States Patent
Watanabe

(10) Patent No.: US 7,520,774 B2
(45) Date of Patent: Apr. 21, 2009

(54) MICRO COAXIAL CABLE CONNECTOR ASSEMBLY

(75) Inventor: Tsuneki Watanabe, Yokohama (JP)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/012,685

(22) Filed: Feb. 4, 2008

(65) Prior Publication Data

US 2008/0188115 A1 Aug. 7, 2008

(30) Foreign Application Priority Data

Feb. 2, 2007 (CN) ..... 2007 2 0034231

(51) Int. Cl.
*H01R 13/04* (2006.01)

(52) U.S. Cl. ..... 439/493; 439/495; 439/497; 439/260; 439/579

(58) Field of Classification Search ..... 439/579, 439/260, 493, 495, 497
See application file for complete search history.

(56) References Cited

U.S. PATENT DOCUMENTS 5,679,008 A * 10/1997 Takahashi et al. ..... 439/76.1
6,250,953 B1 * 6/2001 Niitsu ..... 439/497
6,431,907 B1 * 8/2002 Ma ..... 439/495

* cited by examiner

*Primary Examiner*—Tho D Ta
(74) *Attorney, Agent, or Firm*—Wei Te Chung

(57) ABSTRACT

An micro coaxial cable connector assembly, comprising: an elongate insulative housing having a base portion, a tongue portion extending from the base portion, and a plurality of passageways defined through the base portion and the tongue portion; a plurality of contacts received in the passageways of the insulative housing; a FPC received in the tongue portion; a plurality of wires soldered on the FPC received in the tongue portion; a conductive grounding shield covered onto the insulating housing and the tongue portion; a insulative film adhibited under the conductive grounding shield so that the assembly of the electrical connector is convenient.

11 Claims, 4 Drawing Sheets

MICRO COAXIAL CABLE CONNECTOR ASSEMBLY

FIELD OF THE INVENTION

The present invention related to an electrical connector, and more particularly, to an electrical connector having slideably mounted actuating device to securely and electrically interconnect a cable assembly thereon when the actuating device is located at a closed position.

DESCRIPTIONS OF RELATED ARTS

U.S. Pat. No. 6,685,495 B1 discloses low profiled micro coaxial cable connector, this micro coaxial cable connector comprises an elongate insulative housing, a contact set received in the housing, and a plurality of the wires inserted into the contact set. The insulative housing comprises a base portion, a tongue portion extending from the base portion, and a plurality of passageways defined through the base portion and the tongue portion. The contact set is assembled to a rear end of the housing and comprises an insulative insert and a plurality of contacts, the insulative insert includes a plurality of channels, the contacts are received in the channels, and the contacts extend into the passageways of the housing. The wires are soldered to the contacts and received in the channels of the insulative insert; wherein each of the channels of insulative insert comprises a soldering portion, an obstructing portion in rear of the soldering portion, and a retention portion in rear of the obstructing portion. The obstructing portion is narrower than the soldering portion and the retention portion, and wherein each of the wires has a conductor and an insulation sheathing the conductor, a front exposed end of the conductor is received in corresponding obstructing and soldering portions and soldered to a portion of a corresponding contact in the corresponding soldering portion, and the insulation is received in a corresponding retention portion.

However, The wires must be securely soldered to a plurality of contacts of the cable connector to transmit signals in a reliable manner. To avoid this problem, in the prior art, the wires are one by one manually soldered to the contacts. Such a soldering process is laborious and expensive.

Under this circumstance, a micro coaxial cable connector assembly having a new structure is needed.

SUMMARY OF THE INVENTION

In order to achieve the object set forth, an electrical connector made in accordance with the present invention comprises an insulative housing having a rear portion, and a front portion. A receiving space is defined in a top surface adjacent to the front end along with a plurality of passageways defined in the housing, and which is in communication with the receiving space. A plurality of contact terminals is assembled to the passageways and each contact terminal includes a base positioned within the passageway, and a solder portion located in the rear portion of the housing, and a contact engaging portion extending into the receiving space. An actuating device is pivotally and slideably assembled to sidewalls of the housing and includes a planar portion with a pair of supporting arms extending therefrom. When the planar portion is located in a first position, the receiving space is opened for electrically receiving a cable assembly therein; and when the planar portion is rotated toward the housing, and located in the second position, the planar portion is slidably moving along the sidewall of the housing, and encloses the receiving space.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
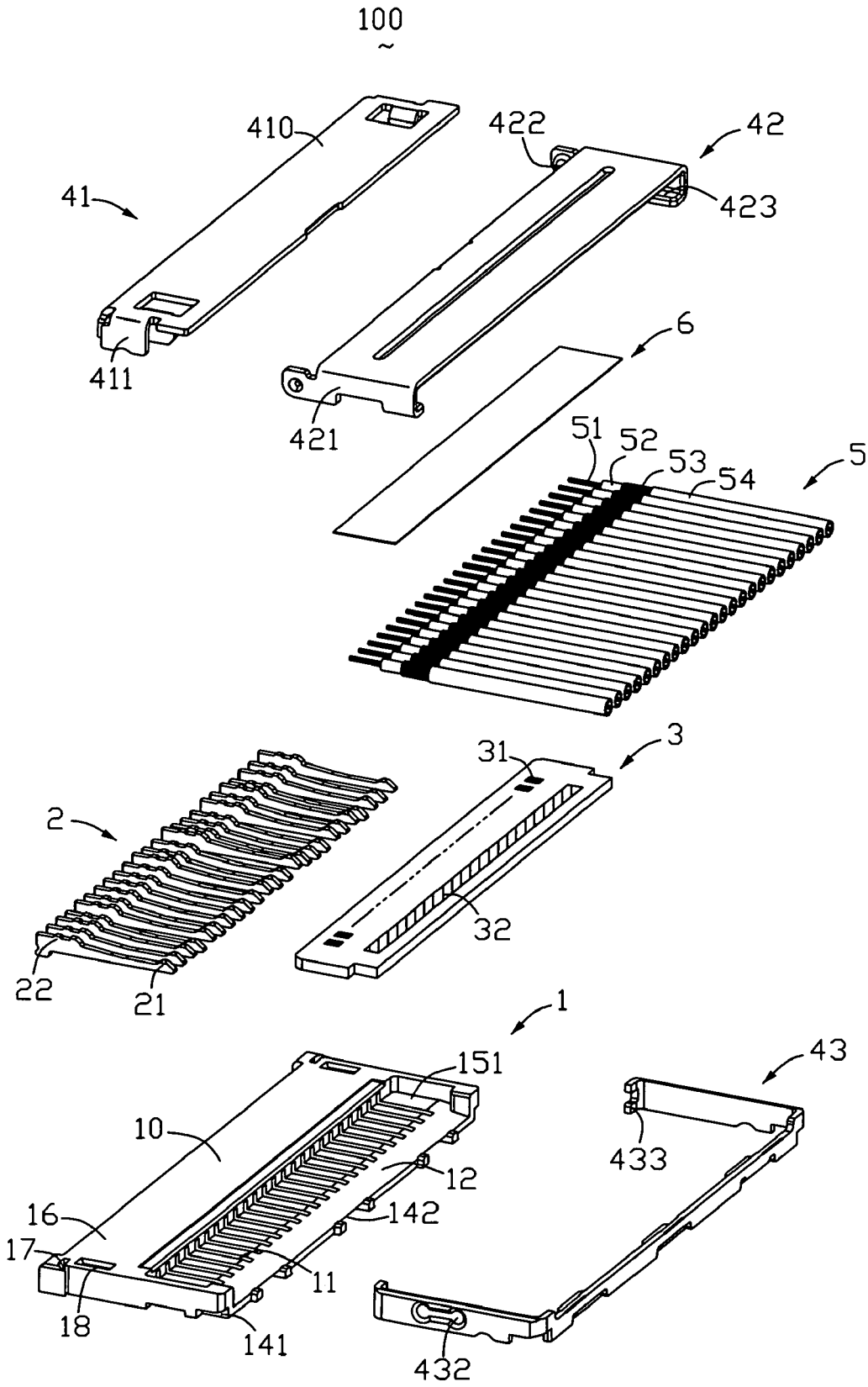
FIG. 1 is an explode perspective view of a micro coaxial cable connector assembly in accordance with the present.
Figure 2:
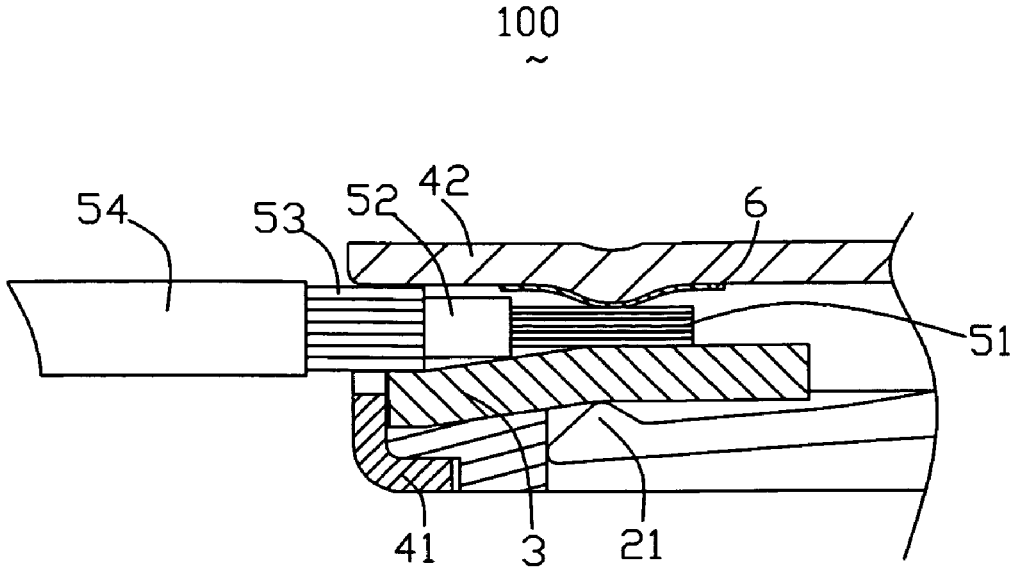
FIG. 2 is a sketch map of the wire soldered on the FPC received in the insulating housing of FIG. 1.
Figure 3:
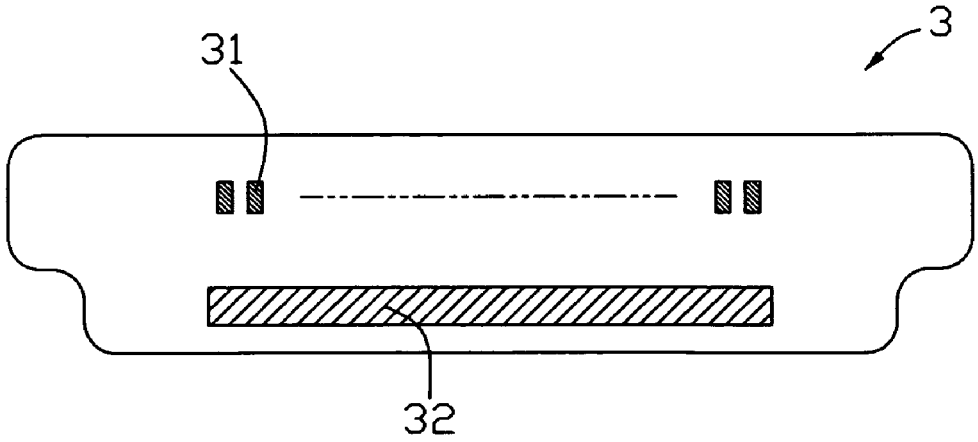
FIG. 3 is a sketch map of the FPC of FIG. 1.
Figure 4:
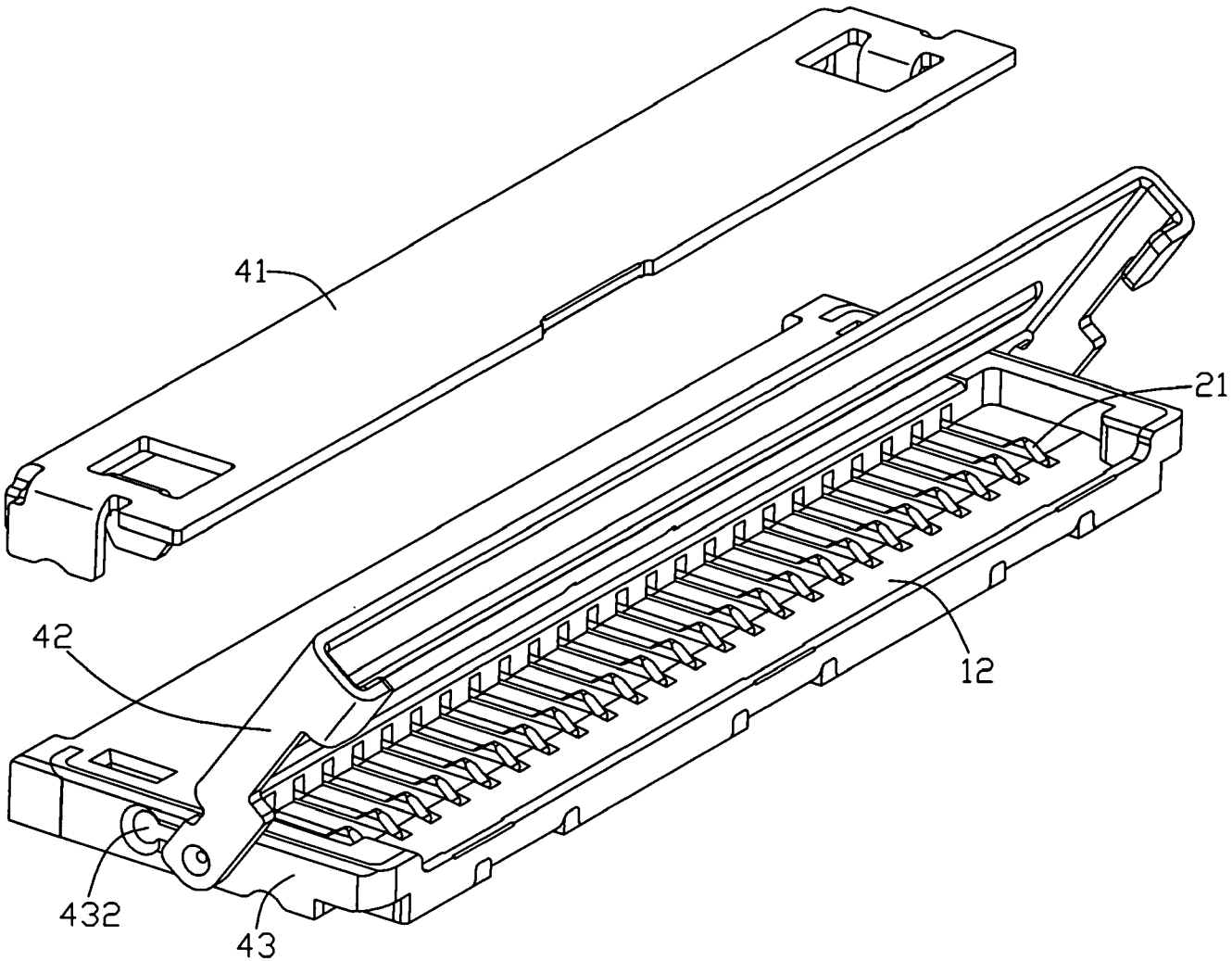
FIG. 4 is an explode perspective view of the micro coaxial cable connector assembly of a grounding shield.
Figure 5:
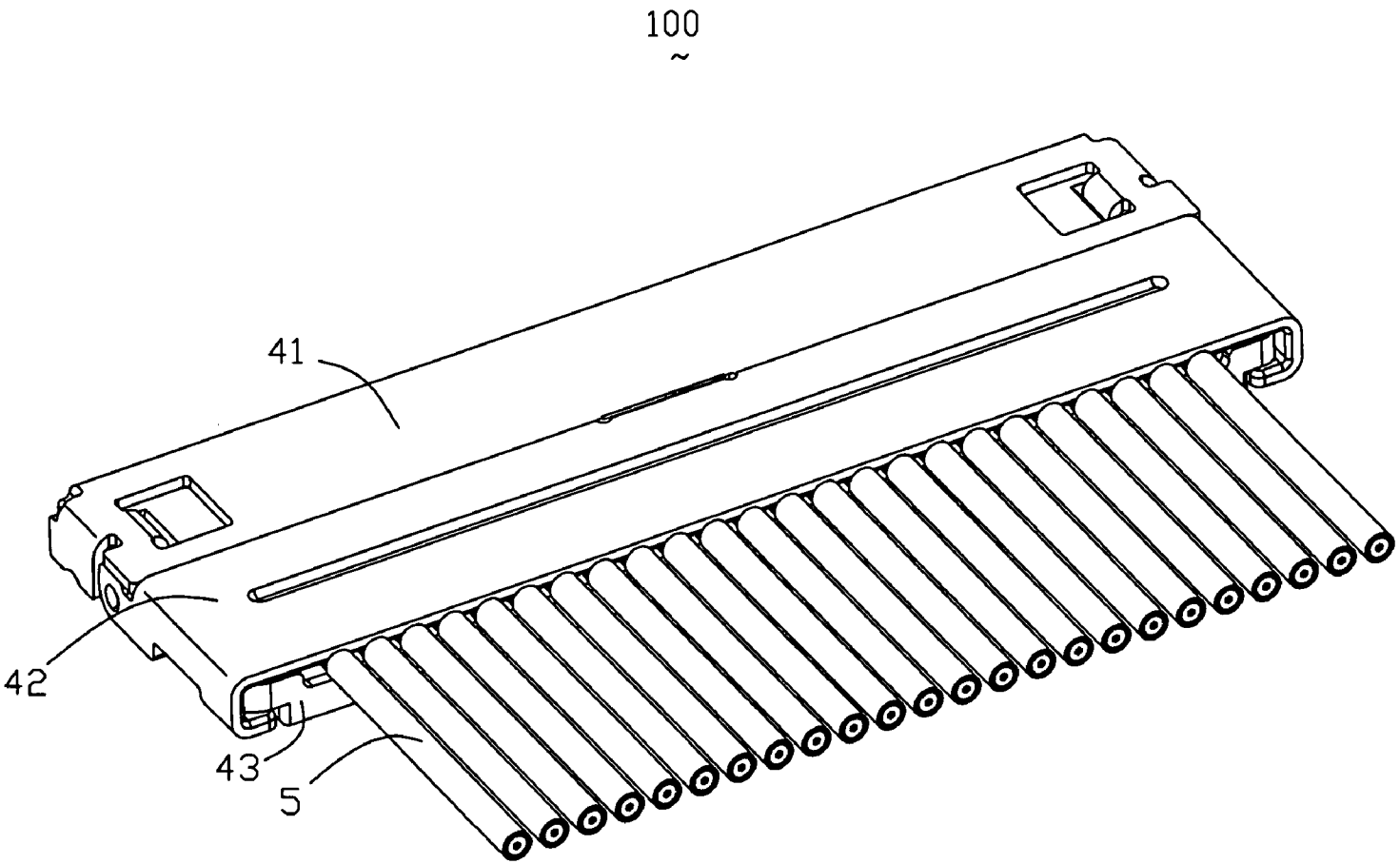

Referring to FIGS. 1, a low profile micro coaxial cable connector 100 of the present invention comprises an insulative housing 1, a plurality of contact terminals 2, an insulative film 6, and a FPC (FLEXIBLE PRINTED CIRCUITS BOARD) 3 received in the insulative housing 1. A shield 4 made of metal covered onto the insulative housing 1.

The insulative housing 1 comprises an elongate base portion 10, a tongue portion 12 extending forwardly from the base portion 10, an upper surface 16 at a top of the base portion 10, and a pair of buckling portion 17 formed on lateral ends of the base portion 10. A pair of slots 18 is defined in an upper surface of base portion 10. The base portion 10 and the tongue portion 12 together define a plurality of passageways 11 from the rear end of the base portion 10 to a front end of the tongue portion 12. A receiving space 151 is formed on lateral ends of the insulative housing 1. The bottom of the receiving space 151 defines a pair of recesses 141 at opposite lateral sides thereof. A plurality of gaps 142 is formed on a bottom face of the base portion 10.

A plurality of contact terminals 2 comprises a retention portion 22 and a connecting portion 21 extending from the retention portions 22. The contact terminals 2 inserted along a rear-to-front direction through corresponding passageways 11 of the insulative housing 1, and a connecting portion 21 exposed to the passageways 11 of tongue portion 12.

A FPC 3 comprises a plurality of soldering points 31 in a front end and a soldering portion 32 in a rear end thereof. Each a conductor 51 of a corresponding wire 5 is soldered with the FPC 3.

The conductive grounding shield 4 comprises a first upper grounding shield 41, a second upper grounding shield 42, and a lower grounding shield 43 connecting the second upper plate 42. The first upper grounding shield 41 assembled to the base portion 10 of the insulative housing 1 in the vertically direction and a lower grounding shield 43 assembled to the base portion 10 of the insulative housing 1 in the horizontal direction. The second upper grounding shield 42 defines a pair of sidewalls 421 and the end of the sidewall 421 defines a pair of projections 422 in an inner side thereof. A pair of receiving holes 432 is formed on lateral portions of the lower grounding shield 43, and each of the receiving holes 432 receiving a corresponding projection 422 of the second upper grounding shield 42. The first upper grounding shield 41 having a flat portion 410 located on the base portion 10 having a latch 411; wherein insulative housing 1 comprises a slot 18 and the latch 411 of the first upper grounding shield 41 assembled to the slot. The lower grounding shield 43 comprises a protrusion 433 and the insulative housing 1 has a buckling portion 17 assembled to the protrusion 433 so that the lower grounding shield 43 and the insulative housing 1 are securely assembled together.

Each of the wires 5 has a conductor 51 and an insulation sheathing 52 wrapped the surface of the conductor 51. The each wire further comprises a metal braiding 53 surrounding the insulation sheathing 52 and the jacket 54 surrounding the metal braiding 53; The conductor 51 of each wire 5 has a front end exposed to outside and the front exposed end of the conductor 51 being soldered on the soldering point 31 of the FPC 3, and the metal braiding 53 being soldered on the soldering portion 32 of the FPC 3;

The insulative film 6 adhibited under the conductive grounding shield in a corresponding the conductor 51 of the wire 5.

Referring to FIGS. 1-4, in assembly, the contact terminals 2 are first inserted into the passageways 11 of the insulative housing 1; the connecting portion 21 exposed to the passageways 11 of tongue portion 12. The conductor 51 of each wire 5 has a front end exposed to outside and the front exposed end of the conductor 51 being soldered on the soldering point 31 of the FPC 3, and the metal braiding 53 being soldered on the soldering portion 32 of the FPC 3.and then the FPC 3 received in the receiving space 151 of the insulative housing 1.

The FPC 3 together with the wires 5 is then assembled to the insulative housing 1. The first upper grounding shield 41 assembled to the base portion 10 of the insulative housing 1 in the vertically direction and a lower grounding shield 43 assembled to the base portion 10 of the insulative housing 1 in the horizontal direction. The projections 421 of the second upper grounding shield 42 is received into the receiving holes 432 of the lower grounding shield 43. The protrusions 433 of the lower grounding shield 43 have an interferential fit with the buckling portion 17 of the insulative housing 1.

Thus, the insulative housing 1, the contact terminals 2, the FPC 3, the insulative film 6, the wires 5, and a shield 4 are assembled together to form the micro coaxial cable connector assembly 100 in accordance with the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector with slideable actuating device, comprising: an insulative housing having a rear portion, and a front portion, a receiving space defined in a top surface adjacent to the front end, a plurality of passageways defined in the housing, and in communication with the receiving space;

a plurality of contact terminals assembled to the passageways, each contact terminal including a base positioned within the passageway, and a solder portion located in the rear portion of the housing, and a contact engaging portion extending into the receiving space;

an actuating device pivotally and slideably assembled to sidewalls of the housing, the actuating device including a planar portion with a pair of supporting arms extending therefrom;

wherein when the planar portion is located in a first position, the receiving space is opened for electrically receiving a cable assembly therein;

wherein when the planar portion is rotated toward the housing, and located in the second position, the planar portion is slidably moving along the sidewall of the housing, and enclose the receiving space;

wherein insulative housing includes a metal frame assembled to the sidewalls of the housing, and having a front panel adjacent to the front end of the housing; and wherein the metal frame includes a guiding arrangement having first and second sockets interconnected by a slot.

2. The electrical connector as recited in claim 1, wherein each of the supporting arms includes an emboss rotationally disposed within the first socket when the planar portion is located in the first position, and moveably sliding into the second socket when the planar portion is located at the second position.

3. The electrical connector as recited in claim 1, wherein the planar portion further includes a bottom portion slideably interengaged with the bottom portion of the housing when the planar portion is located at the second portion.

4. The electrical connector as recited in claim 1, wherein the housing further includes a protecting cover assembled to the rear portion of the housing.

5. An electrical connector with slideable actuating device, comprising:

an insulative housing having a rear portion, and a front portion, a receiving space defined in a top surface adjacent to the front end, a plurality of passageways defined in the housing, and in communication with the receiving space;

a plurality of contact terminals assembled to the passageways, each contact terminal including a base positioned within the passageway, and a solder portion located in the rear portion of the housing, and a contact engaging portion extending into the receiving space;

an actuating device pivotally and slideably assembled to sidewalls of the housing, the actuating device including a planar portion with a pair of supporting arms extending therefrom; and a cable assembly assembled to the housing and including a substrate disposed in the receiving space and pressed toward the contact engaging portion by the actuating device, and a plurality of conductive wires each electrically connected to conductive pads of the substrate;

wherein insulative housing includes a metal frame assembled to the sidewalls of the housing, and having a front panel adjacent to the front end of the housing;

wherein the metal frame includes a guiding arrangement having first and second sockets interconnected by a slot.

6. The electrical connector as recited in claim 5, wherein each of the supporting arms includes an emboss rotationally disposed within the first socket when the planar portion is located in the first position, and moveably sliding into the second socket when the planar portion is located at the second position.

7. The electrical connector as recited in claim 5, wherein the planar portion further includes a bottom portion slideably interengaged with the bottom portion of the housing when the planar portion is located at the second portion.

8. The electrical connector as recited in claim 5, wherein the housing further includes a protecting cover assembled to the rear portion of the housing.

9. An electrical connector assembly comprising:

an insulative housing defining a receiving space;

a plurality of contacts disposed in the housing;

a metallic top cover linearlly moveable between outer and inner positions, wherein said cover is allowed to be rotated at the outer position for easy receiving a printed circuit board in the receiving space, and is reliably retained to the housing at the inner position, said contacts defining contacting sections abutting against one surface of the printed circuit board;

and a plurality of wires abutting against the other surface of said printed circuit board; wherein each of said wires includes an inner conductor soldered on said other surface of the printed circuit board, and an insulative film is sandwiched between the top cover and all said inner conductors opposite to the printed circuit board.

10. The electrical connector assembly as claimed in claim 9, wherein a lower cover is located around a front face of the housing and engaged with a rear edge of the printed circuit board to retain said print circuit board in said receiving space.

11. The electrical connector assembly as claimed in claim 10, wherein said lower cover is metallic.

* * * * *